US008936251B1

(12) United States Patent
Pereira

(10) Patent No.: US 8,936,251 B1
(45) Date of Patent: Jan. 20, 2015

(54) SKATE SYSTEM INCLUDING ACTIVE DISPLACEMENT MECHANISM

(71) Applicant: Odil Talles Pereira, Jardim Chapadão—Campinas/SP (BR)

(72) Inventor: Odil Talles Pereira, Jardim Chapadão—Campinas/SP (BR)

( * ) Notice: Subject to any disclaimer, the term of this patent is extended or adjusted under 35 U.S.C. 154(b) by 0 days.

(21) Appl. No.: 14/262,521

(22) Filed: Apr. 25, 2014

(51) Int. Cl.
*A63C 17/04* (2006.01)
*A63C 17/00* (2006.01)

(52) U.S. Cl.
CPC ..... *A63C 17/0093* (2013.01); *A63C 17/0046* (2013.01)
USPC ..... 280/11.28; 280/11.25

(58) Field of Classification Search
USPC ..... 280/11.28, 11.233, 11.222, 11.225, 280/11.25
See application file for complete search history.

(56) References Cited

U.S. PATENT DOCUMENTS 208,235 A * 9/1878 Gregg ..... 280/11.19
233,845 A * 11/1880 Gregg ..... 280/11.19
1,379,250 A * 5/1921 Clark ..... 280/11.215
1,552,541 A * 9/1925 Clark ..... 280/11.214
1,632,997 A * 6/1927 Connolly ..... 280/11.19
1,751,942 A * 3/1930 Nanz ..... 280/11.25
2,430,037 A * 11/1947 Vincent ..... 280/11.209
3,885,804 A * 5/1975 Cudmore ..... 280/11.204
4,323,259 A * 4/1982 Boudreau ..... 280/7.13
4,394,028 A * 7/1983 Wheelwright ..... 280/11.19
4,709,937 A * 12/1987 Lin et al. ..... 280/11.209
4,763,909 A * 8/1988 Bergeron ..... 280/11.25
4,844,491 A * 7/1989 Wheelwright ..... 280/11.208
5,165,708 A * 11/1992 I-Chuan ..... 280/11.115
5,312,120 A * 5/1994 Wiegner ..... 280/11.212
5,794,955 A * 8/1998 Flynn ..... 280/87.042
5,951,028 A * 9/1999 Lovitt et al. ..... 280/11.222
5,997,018 A * 12/1999 Lee ..... 280/87.042
6,070,885 A * 6/2000 Ferone ..... 280/11.19
6,273,437 B1 * 8/2001 Lovitt et al. ..... 280/11.233
6,286,843 B1 * 9/2001 Lin ..... 280/11.28
6,299,186 B1 * 10/2001 Kao et al. ..... 280/87.041
6,382,646 B1 * 5/2002 Shaw ..... 280/87.041
6,398,229 B1 * 6/2002 Saylor ..... 280/11.19
6,398,238 B1 * 6/2002 Shaw ..... 280/87.042
6,443,464 B2 * 9/2002 Lovitt et al. ..... 280/11.233
6,557,861 B2 * 5/2003 Saylor ..... 280/11.19
6,874,795 B2 * 4/2005 Sung ..... 280/11.223
7,419,168 B2 * 9/2008 Felty ..... 280/11.223
7,631,884 B2 * 12/2009 Cole ..... 280/87.042
7,635,136 B2 * 12/2009 Cole ..... 280/87.042
7,758,054 B2 * 7/2010 Abel et al. ..... 280/11.222
8,413,998 B2 * 4/2013 Sano ..... 280/11.25
8,544,854 B2 * 10/2013 Adams ..... 280/7.13
8,641,054 B2 * 2/2014 Adams ..... 280/11.19
8,690,165 B2 * 4/2014 Adams ..... 280/11.19
8,696,000 B1 * 4/2014 Chen ..... 280/87.041
8,789,835 B2 * 7/2014 Abel et al. ..... 280/11.223
2001/0042966 A1 * 11/2001 Sung ..... 280/11.222
2001/0054804 A1 * 12/2001 Lovitt et al. ..... 280/11.233

* cited by examiner

*Primary Examiner* — Jeffrey J Restifo
(74) *Attorney, Agent, or Firm* — Muncy, Geissler, Olds & Lowe, P.C.

(57) ABSTRACT

A skate device includes a footwear-type boot having a sole, two side wheels positioned on opposite sides of the boot, a cross-jacket, disposed on a front region of the sole, the cross-jacket comprising a side-by-side tube with through holes for receiving screws to fix the cross-jacket to the sole, an active displacement mechanism connected to the two side wheels, the active displacement mechanism comprising a chassis with a clamped shaft that mounts a transfer bar, shaped as a flat plate, to a main joint between two lateral joints, the lateral joints having a center displaced from the main pivot joint, and shock absorbers connected to the lateral joints.

5 Claims, 2 Drawing Sheets

SKATE SYSTEM INCLUDING ACTIVE DISPLACEMENT MECHANISM

BACKGROUND OF THE INVENTION

1. Field of the Invention

The present invention relates to a skate device and, more particularly, to a roller skate system including an active displacement mechanism.

2. Description of the Background Art

Traditional roller skates have wheels aligned in one or two rows. The wheels contact with the ground in the same sequence, so that a balance occurs in the central wheel shaft in the longitudinal direction relative to the boot. Any maneuver taken to perform curves is made with displacement of the contact line of the wheels against the ground to one side, allowing the skates to be positioned at a curved angle.

It is known that such skates have limitations when making sharp turns or shifts towards the direction of travel. This occurs because all the wheels are fixed. It also occurs because in some models of skates these wheels have individual movements under their own axis, and the central shaft remains fixed and aligned relative to the boot and the other wheels.

Certain conventional mechanisms have been developed and applied on skates in order to improve performance and stability.

For example, U.S. Pat. No. 1,552,541 discloses skates that have at least one large diameter roller that extends well above the top surface of the foot plate. These skates have problems performing sudden maneuvers, in addition to the problems revealed in the maintenance of such devices.

SUMMARY OF THE INVENTION

In view of the foregoing and other exemplary problems, drawbacks, and disadvantages of the conventional methods and structures, an exemplary feature of the present invention is to provide a system that improves the skates performance, providing more speed and stability in order to perform complex maneuvers with a high degree of difficulty.

Compared to traditional skates, whether having aligned or parallel wheels, the present system provides an active mechanism applied to the wheels, particularly two opposing wheels operating in synchronicity, offsetting mobility and balance.

According to a non-limiting, exemplary aspect of the invention, a skate device includes a footwear-type boot having a sole, two side wheels positioned on opposite sides of the boot, a cross-jacket, disposed on a front region of the sole, the cross-jacket comprising a side-by-side tube with through holes for receiving screws to fix the cross-jacket to the sole, an active displacement mechanism connected to the two side wheels, the active displacement mechanism comprising a chassis with a clamped shaft that mounts a transfer bar, shaped as a flat plate, to a main joint between two lateral joints, the lateral joints having a center displaced from the main pivot joint, and shock absorbers connected to the lateral joints.

In accordance with certain aspects of the invention, the system includes a footwear-type boot whose sole is flat. It contemplates a basis for the feet, which houses an active mechanical system for the two opposite side wheels. The system allows the wheels to have opposite radial displacements in relation to the boot when activated, aiming to change the horizontal axis line of contact of the wheel against the ground, and this line defines the direction of the movement. The displacement ensures contact against the ground when the boot bends, due to the use of force that occurs with the change of the direction by the user.

The active mechanism has, as its main element, a transfer bar that absorbs all incoming force. In addition, it controls the synchronicity of the arms and opposite movements of the wheels on the slopes of the boots.

BRIEF DESCRIPTION OF THE DRAWINGS

The present invention will become more fully understood from the detailed description given herein below and the accompanying drawings which are given by way of illustration only, and thus, do not limit the present invention, and wherein.

DETAILED DESCRIPTION

Figure 1:
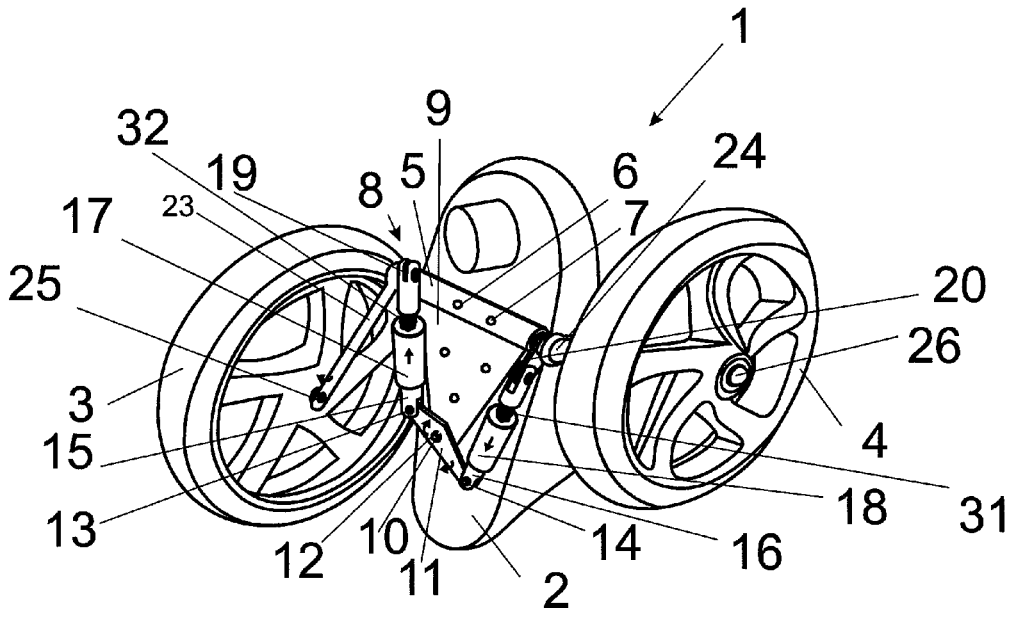
FIG. 1 is a perspective view of the system installed on a skate-type device.

Referring now to the drawings, and more particularly to FIGS. 1-5, there are shown exemplary embodiments of the structures according to the present invention.

A detailed description of the operational concept and constructive design of a system with an active mechanism concerning sports equipment known as skates is provided with reference the drawings. The drawings are not meant to limit the scope of the disclosed invention.

FIG. 1 illustrates a device (1) to practice skating endowed with boot-type shoes having a sole (2) for the feet and two opposite side wheels (3),(4), one on each side of the device (1).

In the sole (2), in the frontal region, a cross-jacket (5) is provided, which is a side-by-side tube with two through-holes (6),(7). The sole (2) receives the attachment, using screws, plus an active displacement mechanism (8) that operates in balance, stability and synchronicity with the wheels (3),(4) and damping applied to the device (1).

The active displacement mechanism (8) comprises a chassis (9) with a clamped shaft (10) in the form of a pin, where it mounts a transfer bar (11) shaped as a flat plate with a main joint (12) between two other lateral joints (13),(14), whose centers are offset from the main pivot joint (12).

Each of the lateral joints (13),(14) is respectively connected to one of the arms (15),(16) that include shock absorbers (17)(18), which due to the transfer bar (11), move in opposite synchronicity proportionally.

Figure 2:
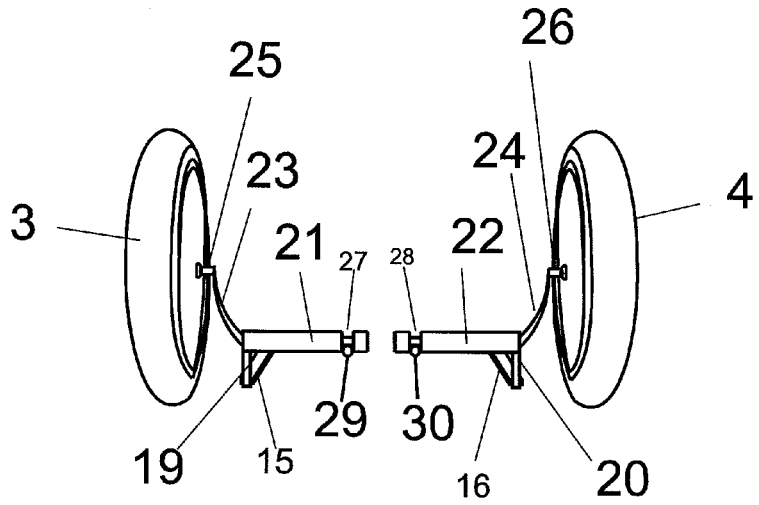
FIG. 2 is a front view of the active mechanism that allows movement in an alternate motion between the wheels.

Each of the shock absorbers (17),(18) is connected to a respective lever (19),(20) in eccentric movements, each fixed to a respective shaft (21),(22). As is illustrated in FIG. 2, the shafts (21),(22) are installed inside of the jacket (5), which turns around its axis and transfers this rotation to the other swivel arms (23),(24) connected to axes (25),(26) of the wheels (3),(4). The shafts (21),(22) are fixed in the jacket (5) through pins (29),(30) inserted in holes (6),(7), which due to the grooves (27),(28) lining the shafts (21)(22), allow rotation of the wheels and prevents the shafts (21),(22) from being disconnected from the jacket (5) when the system is in operation.

Another function of the pins (29),(30) is that removal of the pins allows the removal of the two assemblies of the shafts (21),(22), levers (15),(16), arms (23),(24) and wheels (3),(4).

Figure 3:
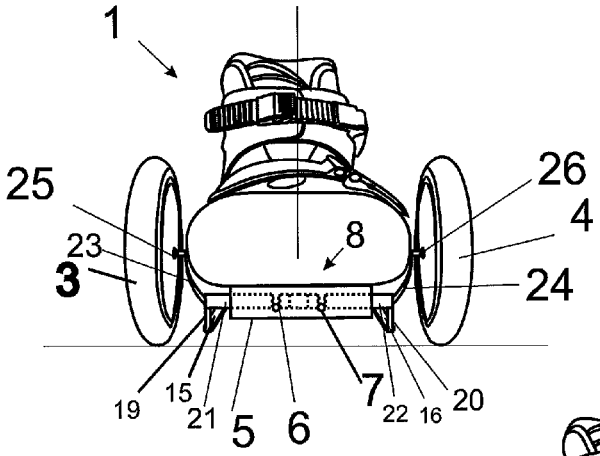
FIG. 3 is a front view of the skates in the resting position on the ground.
Figure 4:
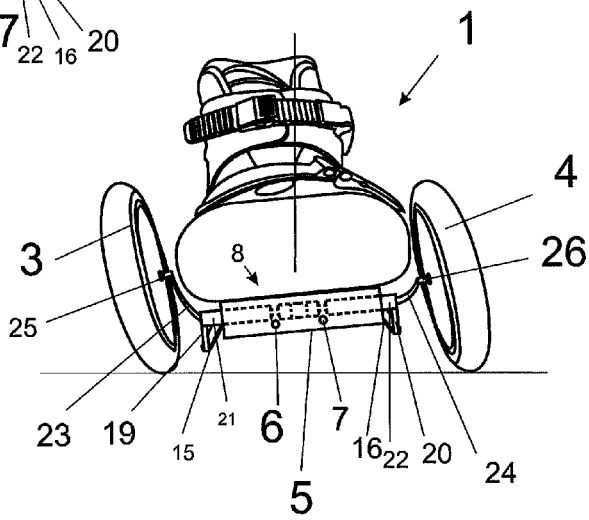
FIG. 4 is a front view of the skates during a curve motion and the active mechanism in operation.
Figure 5:
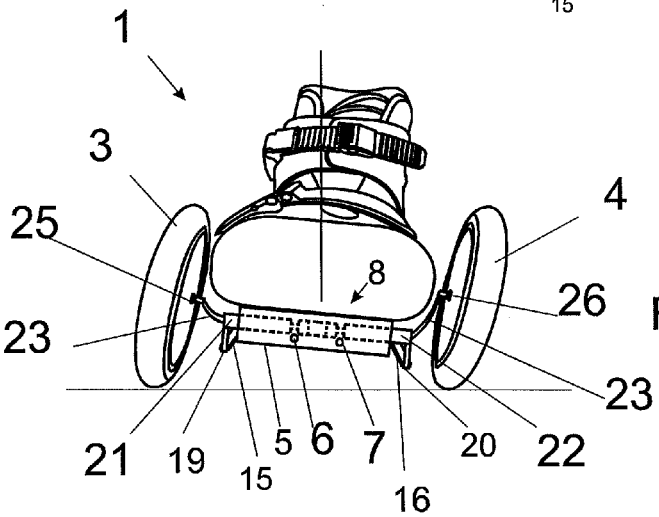
FIG. 5 is a front view of the skates in an opposite curve motion and active mechanism in operation.

As is illustrated in FIG. 3, the active displacement mechanism (8) allows the wheels (3),(4) that are connected to the transfer bar (11) when in a horizontal position, to be aligned at any angle to the sides. As shown in FIGS. 4 and 5, the wheels (3),(4) also move in opposite radial movements acting on the arms (23),(24) of each wheel (3),(4), which, for being fixed to the levers (19),(20), being individually on each shaft (21), (22), transfer to the arms (15),(16) together with the shock absorbers (17),(18) the eccentric movements, and the applied force is absorbed by the transfer bar (11).

Each shock absorber (17),(18) has settings (31),(32) that act directly on the balance of the active mechanism (8) in addition to the absorbing system and height of the system.

The system described above and illustrated in the figures offers to its users means of performing maneuvers and sharp curves. Additionally, due to the use of two opposite wheels, the equipment gains greater speed, control and stability.

The embodiment of the system with active displacement mechanism described in this topic detailing the invention is provided by way of example only. Alterations, modifications and variations can be made to other constructive forms of any particular embodiment by those skilled in the art without, however, departing from the disclosed objective of the patent application, which is defined solely by the appended claims.

The invention claimed is:

1. A skate device, comprising:

a footwear-type boot having a sole;

two side wheels positioned on opposite sides of the boot;

a cross-jacket, disposed on a front region of the sole, the cross-jacket comprising a side-by-side tube with through holes for receiving screws to fix the cross-jacket to the sole;

an active displacement mechanism connected to the two side wheels, the active displacement mechanism comprising a chassis with a clamped shaft that mounts a transfer bar, shaped as a flat plate, to a main joint between two lateral joints, the lateral joints having a center displaced from the main pivot joint; and shock absorbers connected to the lateral joints.

2. The skate device according to claim 1, further comprising arms comprised of the shock absorbers, wherein each of the lateral joints is connected to a respective one of the arms.

3. The skate device according to claim 1, wherein each shock absorber is connected to a lever fixed to a respective shaft, and wherein each respective shaft is installed inside the jacket and each shaft turns around its axis.

4. The skate device according to claim 3, wherein the shafts are fixed inside the jacket through pins inserted in holes in the jacket.

5. The device according to claim 1, wherein each shock absorber comprises settings that act directly on the balance of the active displacement mechanism.

* * * * *